US009751317B2

(12) United States Patent
Nakamura et al.

(10) Patent No.: US 9,751,317 B2
(45) Date of Patent: Sep. 5, 2017

(54) LIQUID EJECTION DEVICE

(71) Applicant: CANON KABUSHIKI KAISHA, Tokyo (JP)

(72) Inventors: Yohei Nakamura, Yokohama (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/288,875

(22) Filed: Oct. 7, 2016

(65) Prior Publication Data

US 2017/0113465 A1 Apr. 27, 2017

(30) Foreign Application Priority Data

Oct. 22, 2015 (JP) ..... 2015-208144

(51) Int. Cl.
*B41J 2/175* (2006.01)
*B41J 2/185* (2006.01)

(52) U.S. Cl.
CPC ..... *B41J 2/17506* (2013.01)

(58) Field of Classification Search
CPC ..... B41J 2/18; B41J 2/185; B41J 2/175
See application file for complete search history.

(56) References Cited

U.S. PATENT DOCUMENTS 5,504,505 A 4/1996 Tamura et al. ..... 347/13
5,617,121 A 4/1997 Tachihara et al. ..... 347/7
2007/0252860 A1* 11/2007 Nitta ..... B41J 2/175 347/14
2011/0050794 A1* 3/2011 Koike ..... B41J 2/125 347/22
2011/0279495 A1* 11/2011 Kuribayashi ..... B41J 2/175 347/6
2013/0076811 A1* 3/2013 Honda ..... B41J 2/17509 347/6
2013/0100199 A1* 4/2013 Suzuki ..... B41J 2/16585 347/22
2013/0100205 A1* 4/2013 Sunouchi ..... B41J 2/175 347/37

FOREIGN PATENT DOCUMENTS

JP 2012-187862 10/2012

* cited by examiner

*Primary Examiner* — Matthew Luu
*Assistant Examiner* — Patrick King
(74) *Attorney, Agent, or Firm* — Fitzpatrick Cella Harper & Scinto

(57) ABSTRACT

A liquid ejection device includes a liquid ejection head, a supply tank connected to the liquid ejection head via a first flow path, a recovery tank connected to the liquid ejection head via a second flow path, a circulation pump arranged in a third flow path, a pressure pump arranged in a fourth flow path configured to connect the recovery tank and the liquid ejection head to each other, and a control portion configured to switch between liquid ejection operation in which liquid is ejected from the liquid ejection head while the liquid is circulated along the first to third flow paths and pressurizing recovery operation in which the liquid pressurized by the pressure pump is supplied to the liquid ejection head via the fourth flow path.

10 Claims, 10 Drawing Sheets

LIQUID EJECTION DEVICE

BACKGROUND OF THE INVENTION

Field of the Invention

The present invention relates to a liquid ejection device having mounted thereon a liquid ejection head configured to eject liquid.

Description of the Related Art

A liquid ejection device configured to record an image on a recording medium through ejection of liquid such as ink generally has mounted thereon a liquid ejection head configured to eject liquid. As a mechanism configured to eject liquid from the liquid ejection head, in many cases, there is used a mechanism configured to generate a pressure in a pressure chamber storing the liquid, to thereby eject, using the pressure, the liquid in the pressure chamber through an ejection orifice formed at one end of the pressure chamber. As methods of generating the pressure, there are given by, for example, reducing the capacity of the pressure chamber using a piezoelectric element, and by bubbling the liquid using a heating element to generate the pressure.

It is known that, in a liquid ejection head, presence of an air bubble in the pressure chamber considerably lowers droplet ejection performance. An air bubble is present in the pressure chamber due to various factors. For example, an air bubble is formed due to cavitation caused by pressure change in ejection or is brought into the pressure chamber from a supply flow path of the liquid. In order to remove such an air bubble from the pressure chamber, some methods are hitherto proposed.

For example, in Japanese Patent Application Laid-Open No. 2012-187862, there is disclosed a liquid ejection device in which a liquid circulating path including an upper tank, a liquid ejection head, a lower tank, and a circulation pump is formed. The upper tank is located above the liquid ejection head in a gravitational direction and can supply liquid to the liquid ejection head using a pressure head difference. The lower tank is located below the liquid ejection head in the gravitational direction and can recover the liquid from the liquid ejection head using a pressure head difference. The circulation pump is configured to return the liquid in the lower tank to the upper tank. With this configuration, the liquid ejection device disclosed in Japanese Patent Application Laid-Open No. 2012-187862 can record an image through ejection of the liquid from the liquid ejection head while the liquid is circulated along the circulating path described above. Through circulation of the liquid through the pressure chamber of the liquid ejection head in this way, not only an air bubble remaining in the pressure chamber can be removed together with the liquid but also thickening of the liquid in an ejection orifice can be suppressed.

Further, in the liquid ejection device disclosed in Japanese Patent Application Laid-Open No. 2012-187862, through driving of the circulation pump under a state in which an air release valve of the upper tank is closed to shut off a flow path between the liquid ejection head and the lower tank, pressurized liquid can be supplied to the liquid ejection head and can be discharged through the ejection orifice. Such pressurizing recovery operation enables droplet ejection performance to be satisfactorily maintained even in a liquid ejection head having a larger number of ejection orifices for attaining higher speed recording.

The liquid ejection device disclosed in Japanese Patent Application Laid-Open No. 2012-187862 is configured to pressurize the liquid via air in the upper tank in the pressurizing recovery operation described above. Therefore, at the end of the pressurizing recovery operation, compressed air in the upper tank expands until the pressure becomes equal to atmospheric pressure, and the expanded air causes the liquid to be kept discharged through the ejection orifices wastefully. Meanwhile, when, in order to suppress this problem, the air release valve of the upper tank is opened, the pressure of the compressed air abruptly becomes atmospheric pressure. The abrupt pressure reduction causes the ejection orifices to take in air, and as a result, the droplet ejection performance is lowered.

SUMMARY OF THE INVENTION

It is an object of the present invention to provide a liquid ejection device that can satisfactorily maintain droplet ejection performance while reducing unnecessary liquid consumption.

In order to attain the object described above, according to one embodiment of the present invention, there is provided a liquid ejection device, including: a liquid ejection head including: a supply port configured to supply liquid to a pressure chamber, the pressure chamber communicating with an ejection orifice for ejecting the liquid; and a recovery port configured to recover the liquid supplied to the pressure chamber; a first flow path connected to the supply port of the liquid ejection head; a supply tank configured to store the liquid supplied to the liquid ejection head, the supply tank being connected to the supply port of the liquid ejection head via the first flow path; a second flow path connected to the recovery port of the liquid ejection head; a recovery tank configured to store the liquid recovered from the liquid ejection head, the recovery tank being connected to the recovery port of the liquid ejection head via the second flow path, and a liquid level of the recovery tank being below an ejection orifice surface in which the ejection orifice of the liquid ejection head opens in a gravitational direction and being below a liquid level of the supply tank in the gravitational direction; a third flow path configured to connect the supply tank and the recovery tank to each other; a circulation pump configured to return the liquid in the recovery tank to the supply tank, the circulation pump being arranged in the third flow path; a fourth flow path configured to connect one of the supply tank and the recovery tank to the liquid ejection head; a pressure pump configured to pressurize the liquid in the one of the supply tank and the recovery tank and supply the liquid to the liquid ejection head, the pressure pump being arranged in the fourth flow path; and a control portion configured to switch between liquid ejection operation in which the liquid is ejected from the liquid ejection head while the liquid is circulated along the first flow path to the third flow path and pressurizing recovery operation in which the liquid pressurized by the pressure pump is supplied to the liquid ejection head via the fourth flow path.

In the liquid ejection device, the pressurized liquid is supplied to the liquid ejection head by the pressure pump only via the fourth flow path without passing through a tank containing air or the like. Therefore, unnecessary liquid consumption accompanying return to atmospheric pressure after the pressurizing recovery operation can be reduced to the minimum.

Further features of the present invention will become apparent from the following description of exemplary embodiments with reference to the attached drawings.

DESCRIPTION OF THE EMBODIMENTS

Now, embodiments of the present invention are described with reference to the attached drawings.

First Embodiment

First, the structure of a liquid ejection head according to a first embodiment of the present invention is described with reference to FIG. 1 to FIG. 4.

Figure 1:
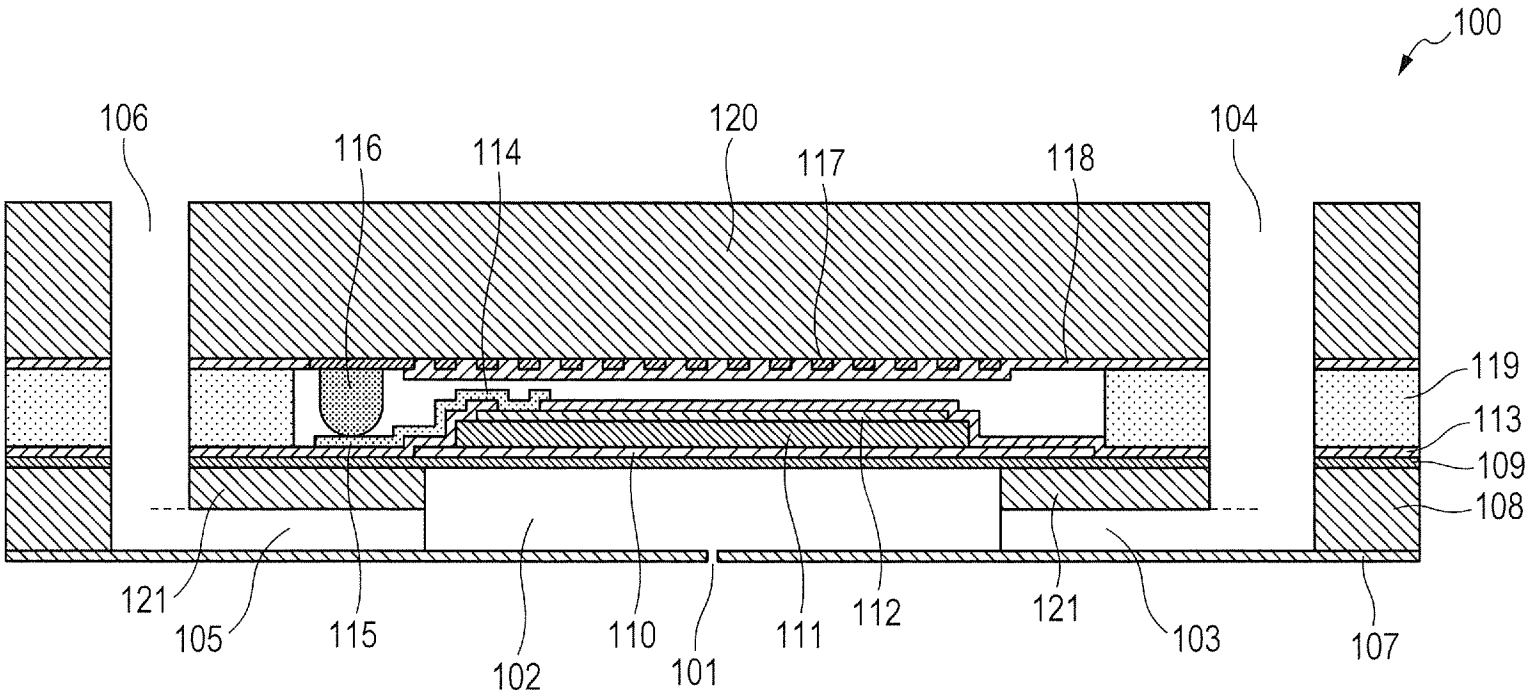
FIG. 1 is a sectional view of a liquid ejecting portion of a liquid ejection head according to a first embodiment of the present invention.
Figure 2:
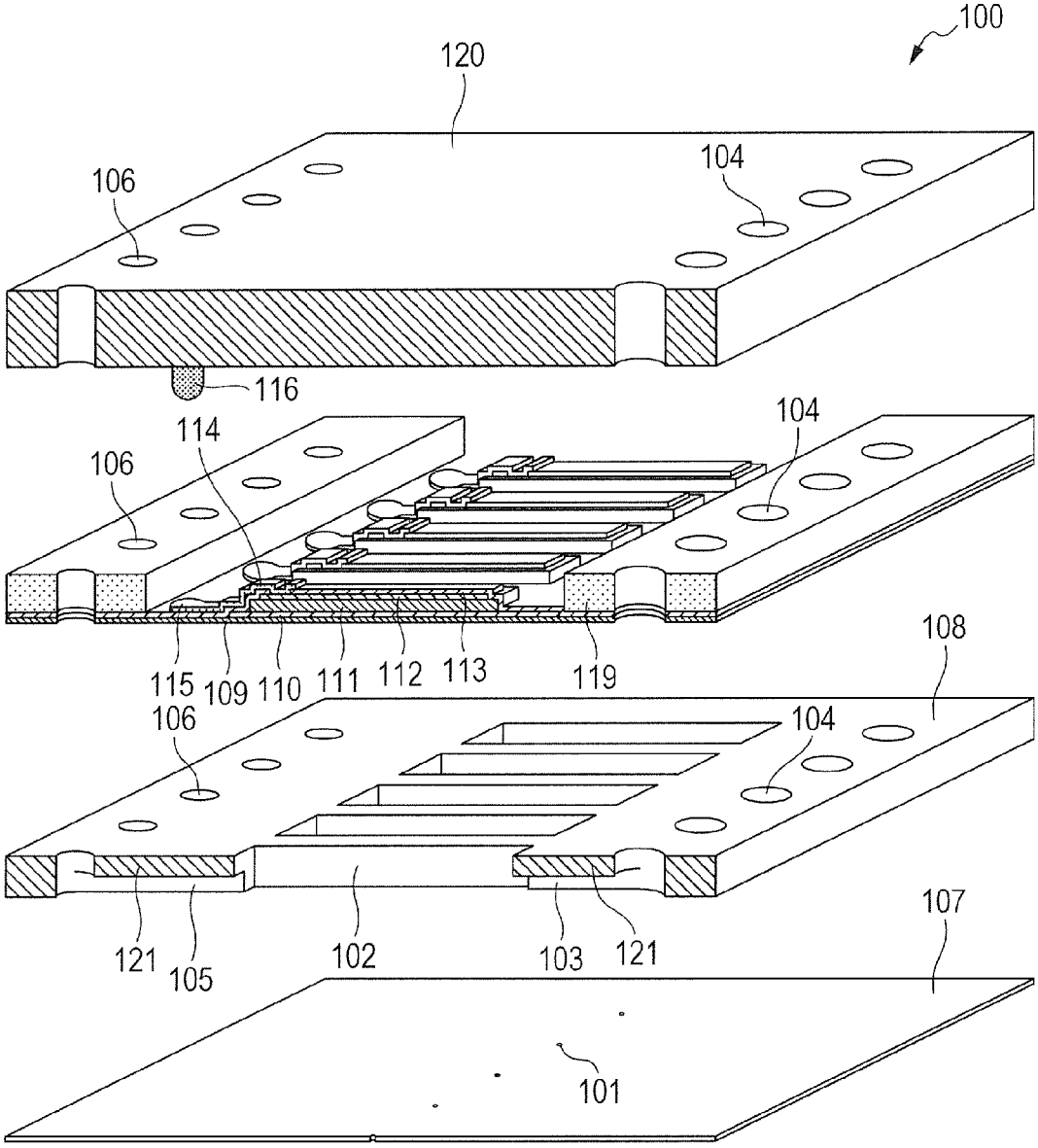
FIG. 2 is an exploded perspective view of the liquid ejecting portion of the liquid ejection head according to the first embodiment.

FIG. 1 is a sectional view of a liquid ejecting portion of the liquid ejection head according to this embodiment. FIG. 2 is an exploded perspective view of the liquid ejecting portion of the liquid ejection head according to this embodiment.

A liquid ejecting portion 100 includes a plurality of ejection orifices 101 for ejecting liquid therethrough and a plurality of pressure chambers 102 configured to store the liquid and communicating with the plurality of ejection orifices 101, respectively. A supply path 103 and a supply opening 104 configured to supply the liquid to each of the pressure chambers 102 and a recovery path 105 and a recovery opening 106 configured to recover the liquid from the pressure chamber 102 communicate with the pressure chamber 102. Therefore, a flow path is formed in the liquid ejecting portion 100 for the liquid to flow into the pressure chamber 102 from the supply opening 104 via the supply path 103, and to flow out of the recovery opening 106 from the pressure chamber 102 via the recovery path 105.

The ejection orifices 101 are formed in an ejection orifice forming member 107. A surface of the ejection orifice forming member 107 opposite to the pressure chambers 102, that is, a surface of the ejection orifice forming member 107 on a liquid ejection side is water-repellent. Further, the pressure chambers 102, the supply paths 103, and the recovery paths 105 are formed in a pressure chamber forming member 108.

The liquid ejecting portion 100 further includes a diaphragm 109 formed on the pressure chamber forming member 108 and forming an upper surface of the pressure chambers 102 and a plurality of piezoelectric elements 111 formed on the diaphragm 109 via a common electrode 110 so as to correspond to the pressure chambers 102, respectively. In addition to the common electrode 110, individual electrodes 112 for applying electric signals to the piezoelectric elements 111 are electrically connected to the piezoelectric elements 111, respectively. A protective film 113 for insulating and protecting the diaphragm 109, the common electrode 110, the piezoelectric elements 111, and the individual electrodes 112 is formed thereon.

The individual electrode 112 is formed for each of the piezoelectric elements 111 and is electrically connected to a bump 116 via lead out wiring 114 and a bump pad 115. The common electrode 110 is also electrically connected to another bump (not shown). The bump 116 is formed of, for example, Au, and is electrically connected to a control circuit (not shown) formed outside the liquid ejection head via electric wiring 117 on a wiring board 120. Through use of the bump 116, electric connection between the electric wiring 117 and the piezoelectric element 111 can easily be made. A protective film 118 for insulating and protecting the electric wiring 117 is formed on the wiring board 120.

When an electric signal is applied from the control circuit to the piezoelectric element 111, the piezoelectric element 111 deforms the diaphragm 109. With this, the pressure chamber 102 contracts and expands to apply pressure to the liquid in the pressure chamber 102, thereby enabling ejection of the liquid through the ejection orifice 101. The supply path 103 and the recovery path 105 for the liquid have capacity generating inertia larger than that of the ejection orifice 101 so that the pressure generated in the pressure chamber 102 goes toward the ejection orifice 101.

A photosensitive resin 119 is formed on the protective film 113, and the wiring board 120 described above is joined to the photosensitive resin 119. As the photosensitive resin 119, for example, a photosensitive dry film such as DF470 (manufactured by Hitachi Chemical Co., Ltd.) can be used. It is enough that the photosensitive resin 119 is a resin material that can be photopatterned, and thus the photosensitive resin 119 may be alternatively a photosensitive liquid resist.

The supply openings 104 and the recovery openings 106 are formed so as to penetrate the wiring board 120, the protective film 118, the photosensitive resin 119, the protective film 113, and the diaphragm 109 to communicate with the supply paths 103 and the recovery paths 105, respectively, in the pressure chamber forming member 108. A structure 121 for reducing the cross sectional areas of the supply path 103 and the recovery path 105 to narrow the flow path is arranged in the pressure chamber forming member 108. The structure 121 is formed so as to be in contact with the diaphragm 109, and also has the function of suppressing deformation of the diaphragm 109 due to swelling of the photosensitive resin 119 in contact with the liquid to change the cross sectional area of the supply path 103 and to damage the diaphragm 109.

Figure 3:
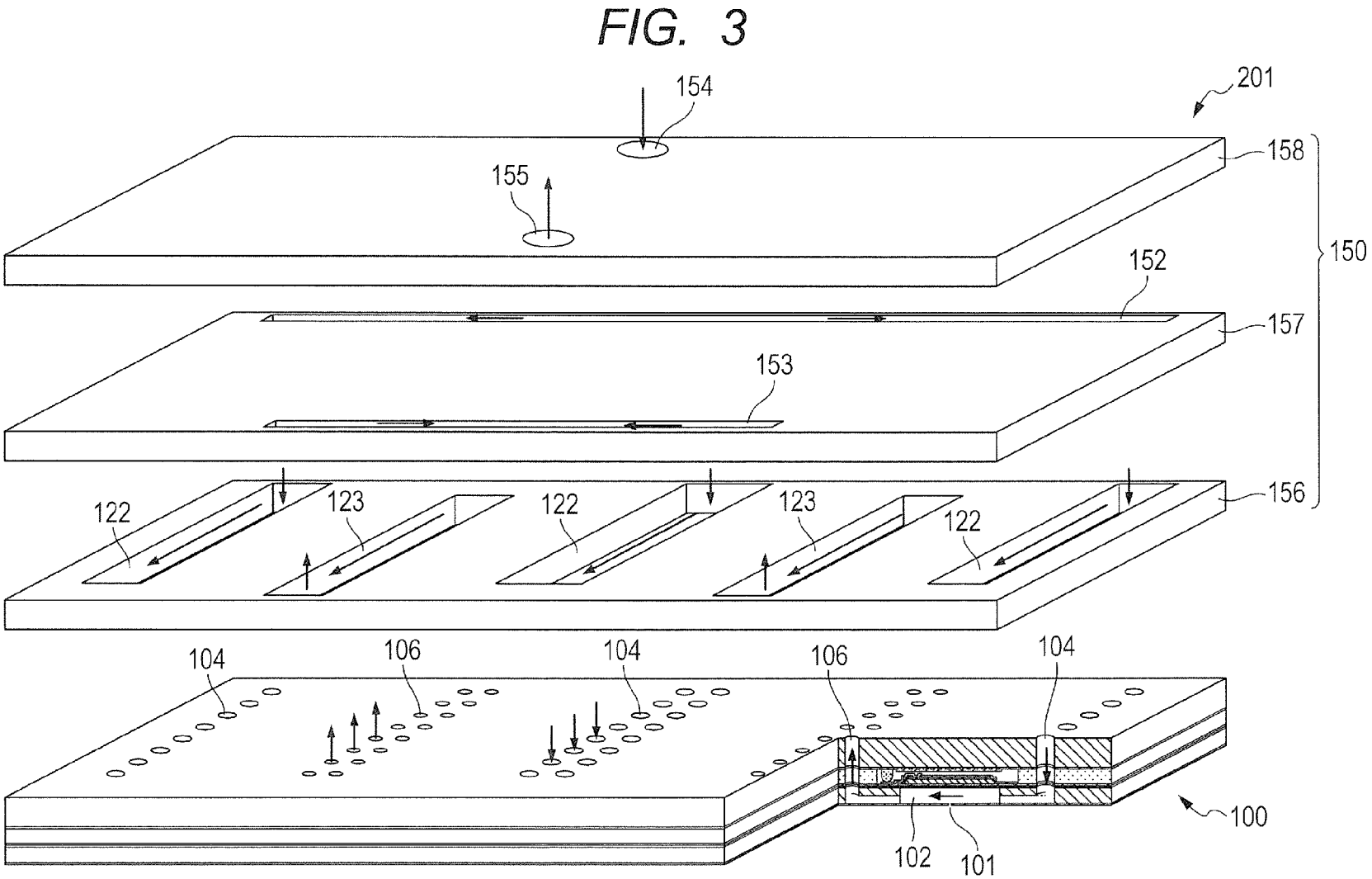
FIG. 3 is an exploded perspective view of a manifold portion of the liquid ejection head according to the first embodiment.

FIG. 3 is an exploded perspective view of a manifold portion of the liquid ejection head according to this embodiment.

A manifold portion 150 of a liquid ejection head 201 includes a port layer 158, a transport flow path layer 157, and a common flow path layer 156. A supply port 154 and a recovery port 155 are formed in the port layer 158. A supply transport flow path 152 and a recovery transport flow path 153 are formed in the transport flow path layer 157.

Common supply flow paths 122 and common recovery flow paths 123 are formed in the common flow path layer 156.

The supply port 154 communicates with a liquid supply flow path (not shown) to be described below that is formed outside the liquid ejection head 201 and with the supply transport flow path 152. The supply transport flow path 152 communicates with the common supply flow paths 122. The common supply flow paths 122 communicate with the plurality of supply openings 104. Further, the recovery port 155 communicates with a liquid recovery flow path (not shown) to be described below that is formed outside the liquid ejection head 201 and with the recovery transport flow path 153. The recovery transport flow path 153 communicates with the common recovery flow paths 123. The common recovery flow paths 123 communicate with the plurality of recovery openings 106.

The arrows in FIG. 3 indicate flows of the liquid in the manifold portion 150 and the liquid ejecting portion 100. Specifically, the liquid supplied from the liquid supply flow path flows into the common supply flow paths 122 from the supply port 154 via the supply transport flow path 152, and flows into the respective pressure chambers 102 via the supply openings 104. The liquid passing through the pressure chambers 102 flows into the common recovery flow paths 123 via the recovery openings 106, and is recovered to the liquid recovery flow path via the recovery transport flow path 153 and the recovery port 155.

Figure 4:
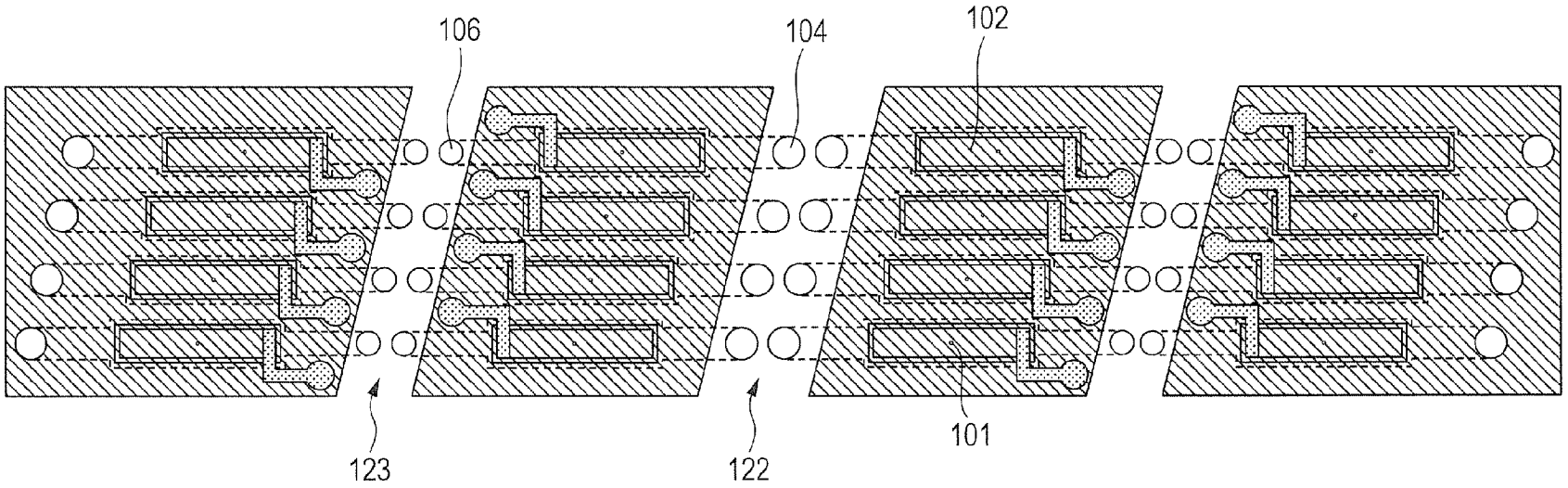
FIG. 4 is a transparent plan view of the liquid ejecting portion and the manifold portion according to the first embodiment.

FIG. 4 is a transparent plan view of the liquid ejecting portion and the manifold portion according to this embodiment.

Horizontal intervals between adjacent ejection orifices 101 in each of ejection orifice lines are, for example, 21.17 μm (corresponding to 1,200 dpi). With this, an image of 1,200 dpi can be formed through ejection of liquid simultaneous with relative up-and-down movement of the liquid ejection head with respect to a recording medium in a plane of FIG. 4.

The pressure chambers 102 adjacent to each other in a transverse direction are formed so that the supply openings 104 or the recovery openings 106 are adjacent to each other. One common supply flow path 122 is formed for two supply opening columns, and one common recovery flow path 123 is formed for two recovery opening columns. With this, the area efficiency of the liquid ejection head can be improved.

Figure 5:
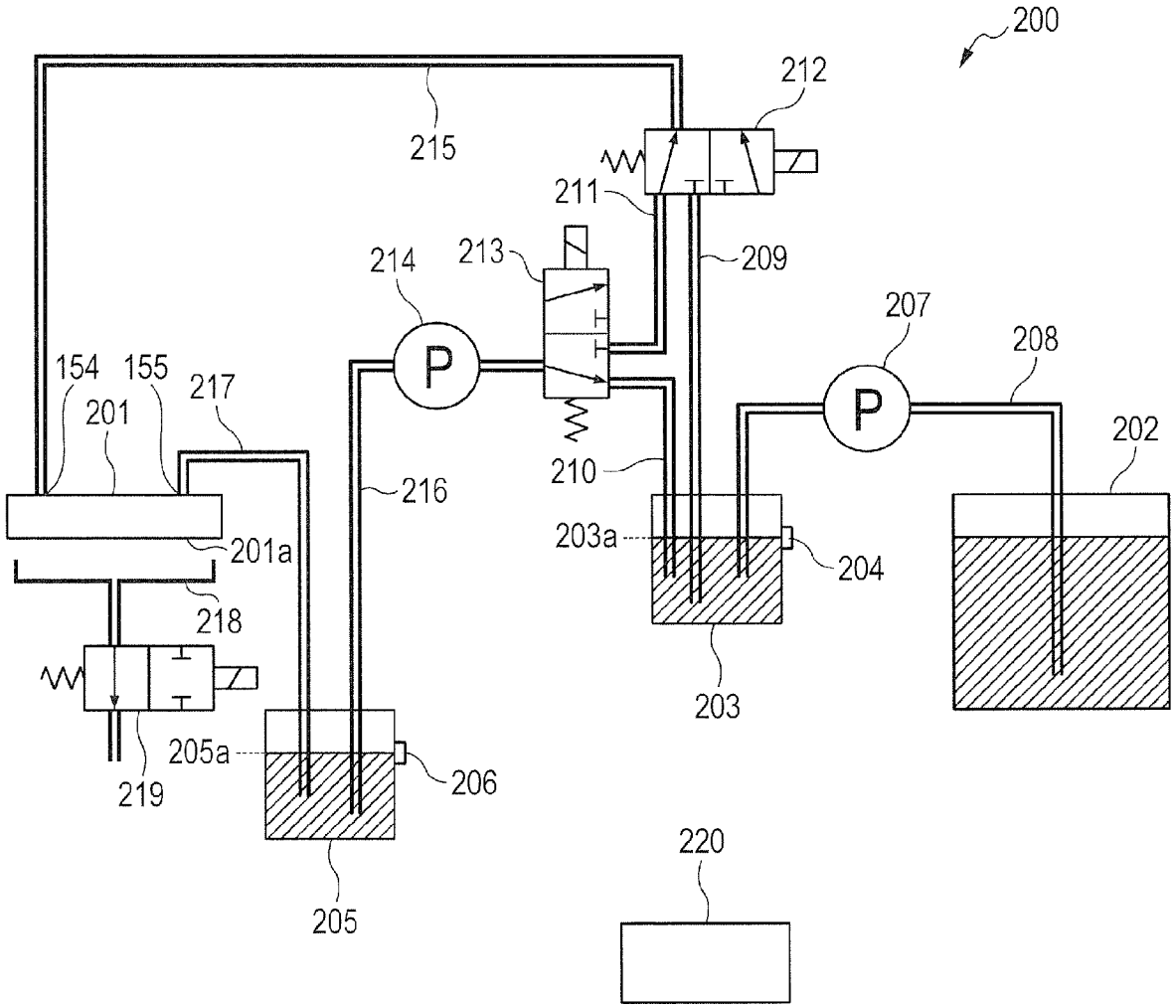
FIG. 5 is a schematic view for illustrating the flow path structure of a liquid ejection device according to the first embodiment.

Next, the structure of the liquid ejection device according to this embodiment is described with reference to FIG. 5. FIG. 5 is a schematic view for illustrating the flow path structure of the liquid ejection device according to this embodiment.

A liquid ejection device 200 includes the liquid ejection head 201, a main tank 202, a supply tank 203, a recovery tank 205, a cap 218, and a control portion 220.

The liquid ejection head 201 includes the liquid ejecting portion and the manifold portion described above, and is connected to a liquid supply flow path 215 and a liquid recovery flow path 217 via the supply port 154 and the recovery port 155, respectively, in the manifold portion. The cap 218 is arranged below the liquid ejection head 201 and is formed so as to be movable between a position at which the cap 218 abuts against a surface of the liquid ejection head 201 in which the ejection orifices are opened, that is, an ejection orifice surface 201*a*, so as to cover the ejection orifices of the liquid ejection head 201, and a position at which the cap 218 is apart from the ejection orifice surface 201*a*. A cap sealing valve 219 for opening/closing a space formed between the cap 218 and the ejection orifice surface 201*a* when the cap 218 abuts against the ejection orifice surface 201*a* in the liquid ejection head 201 is mounted to the cap 218. Through opening/closing of the cap sealing valve 219, discharge of waste fluid and sealing of the ejection orifices can be switched.

One end of the liquid supply flow path 215 is connected to the supply port 154 in the liquid ejection head 201 and another end thereof is connected to a supply switching valve 212. The supply switching valve 212 is connected to one end of a supply connection flow path 209 and another end of the supply connection flow path 209 is connected to the supply tank 203. The supply tank 203 is connected to the main tank 202 via a refill flow path 208. The refill flow path 208 includes a refill pump 207 configured to refill the supply tank 203 with the liquid from the main tank 202. A liquid level sensor 204 configured to detect a liquid level in the supply tank 203 is mounted to the supply tank 203.

One end of the liquid recovery flow path 217 is connected to the recovery port 155 in the liquid ejection head 201 and another end thereof is connected to the recovery tank 205. The recovery tank 205 is connected to one end of a circulation flow path 216, and another end of the circulation flow path 216 is connected to a circulation switching valve 213. The circulation switching valve 213 is connected to one end of a return flow path 210, and another end of the return flow path 210 is connected to the supply tank 203. The circulation switching valve 213 is also connected to one end of a pressurized flow path 211, and another end of the pressurized flow path 211 is connected to the supply switching valve 212. The circulation flow path 216 includes a circulation pump 214. A liquid level sensor 206 configured to detect a liquid level in the recovery tank 205 is mounted to the recovery tank 205.

The supply tank 203 is arranged so that a liquid level 203*a* in the supply tank 203 is above a liquid level 205*a* in the recovery tank 205 in a gravitational direction. The recovery tank 205 is arranged so that the liquid level 205*a* is below the ejection orifice surface 201*a* of the liquid ejection head 201 in the gravitational direction.

The control portion 220 controls driving of the refill pump 207 and the circulation pump 214 based on output signals from the liquid level sensors 204 and 206, respectively. Further, the control portion 220 controls the supply switching valve 212, the circulation switching valve 213, the cap 218, and the cap sealing valve 219 to switch operation of the liquid ejection head 201. Specific control operation by the control portion 220 is to be described below.

Figure 6:
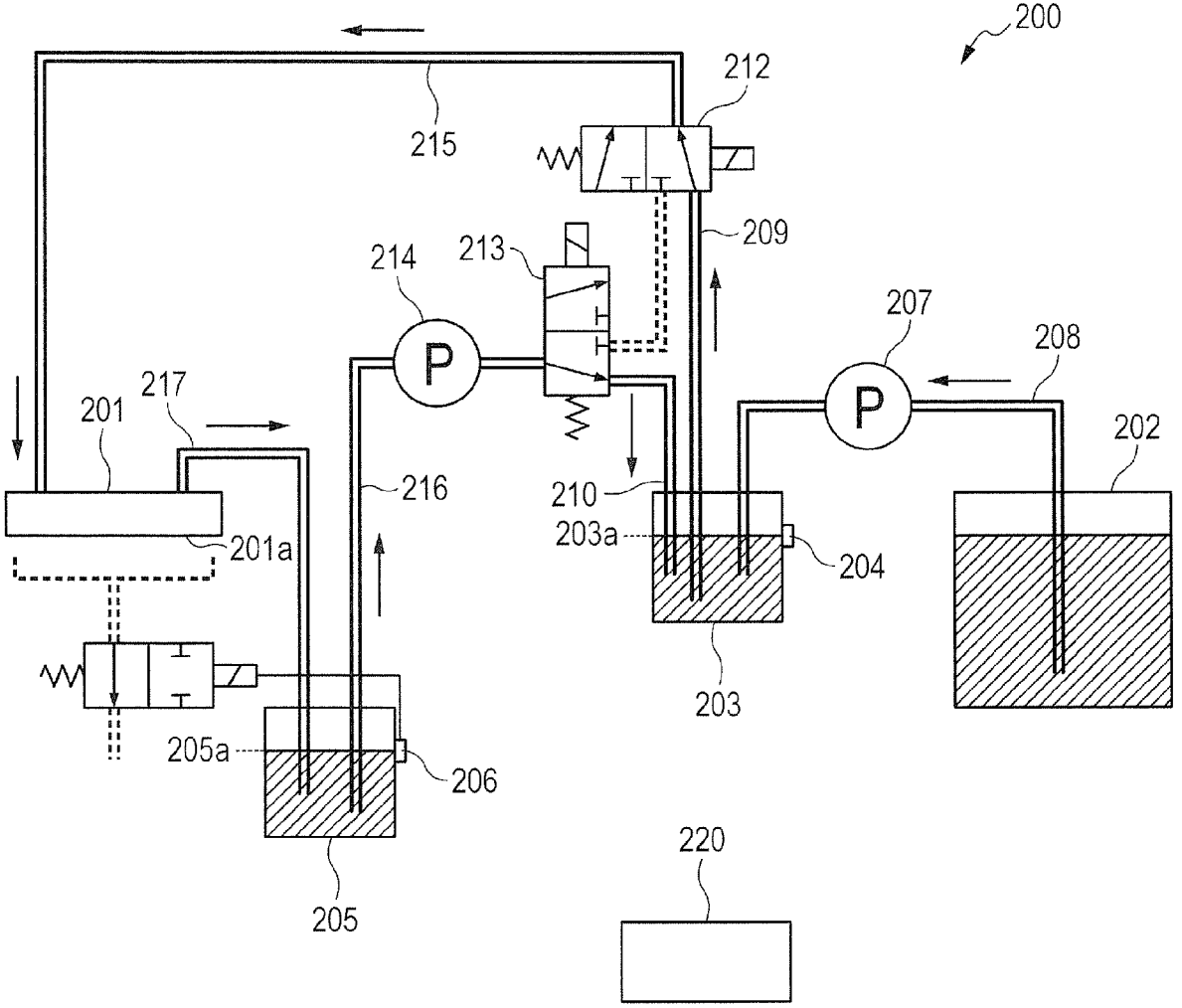
FIG. 6 is another schematic view for illustrating the flow path structure of the liquid ejection device according to the first embodiment.
Figure 7:
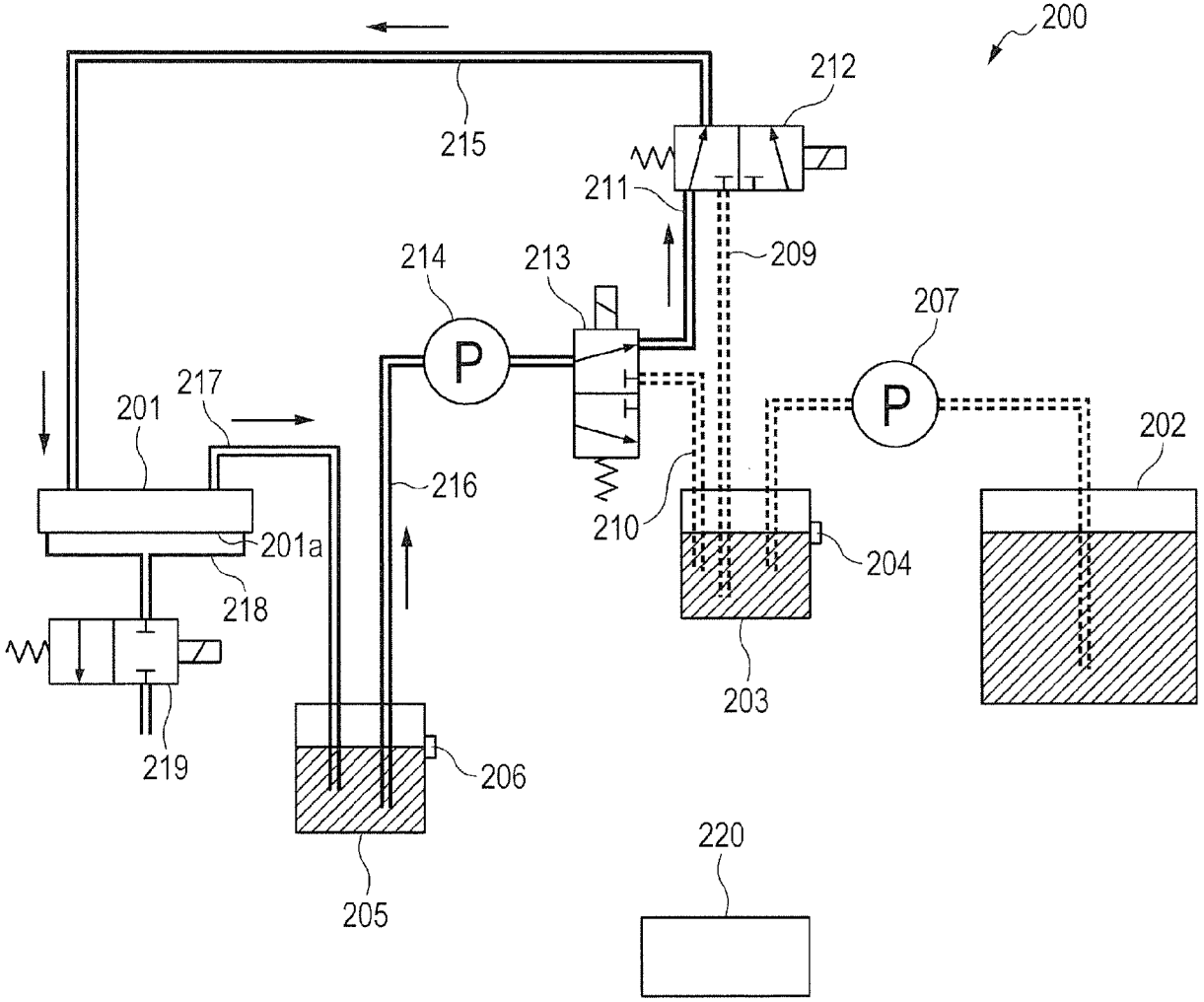
FIG. 7 is still another schematic view for illustrating the flow path structure of the liquid ejection device according to the first embodiment.
Figure 8:
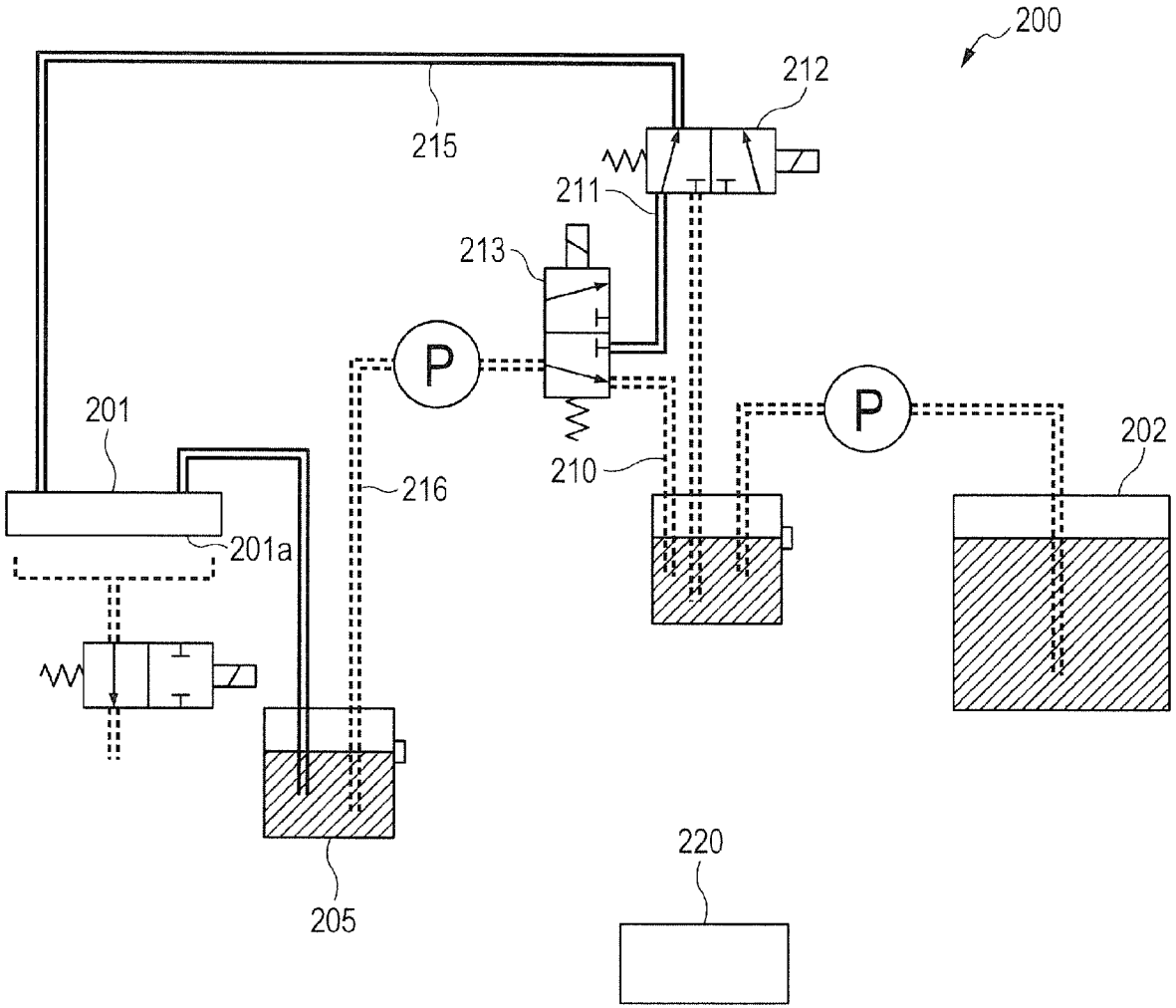
FIG. 8 is yet another schematic view for illustrating the flow path structure of the liquid ejection device according to the first embodiment.

Here, operation of the liquid ejection device according to this embodiment is described with reference to FIG. 6 to FIG. 8. FIG. 6, FIG. 7, and FIG. 8 are schematic views for illustrating the flow path structure of the liquid ejection device according to this embodiment in liquid ejection operation, pressurizing recovery operation, and power off operation, respectively.

(Liquid Ejection Operation)

In the liquid ejection operation, as illustrated in FIG. 6, the control portion 220 controls the supply switching valve 212 to connect the supply connection flow path 209 and the liquid supply flow path 215 to each other, and controls the circulation switching valve 213 to connect the circulation flow path 216 and the return flow path 210 to each other. With this, the supply connection flow path 209 and the liquid supply flow path 215 function as a first flow path configured to connect the supply tank 203 and the liquid ejection head 201 to each other, and the liquid recovery flow path 217 functions as a second flow path configured to connect the liquid ejection head 201 and the recovery tank 205 to each other. Further, the circulation flow path 216 and the return flow path 210 function as a third flow path configured to connect the recovery tank 205 and the supply tank 203 to each other. Therefore, in the liquid ejection operation, a circulating path is formed that includes the supply tank 203, the first flow path 209 and 215, the liquid ejection head 201, the second flow path 217, the recovery tank 205, and the third flow path 216 and 210.

The liquid fills the entire circulating path. Due to a pressure head difference between the supply tank 203 and the recovery tank 205, the liquid can flow in a direction of the arrows in FIG. 6 from the supply tank 203 to the recovery tank 205. When the liquid level sensor 206 detects that the liquid level 205*a* in the recovery tank 205 is above a predetermined level, the control portion 220 drives the circulation pump 214 to return the liquid in the recovery tank 205 to the supply tank 203. With this, the liquid level in the recovery tank 205 is controlled to be the predetermined level or lower. In this way, in the liquid ejection operation, the liquid can be ejected from the liquid ejection head 201 while the liquid is circulated along the circulating path described above.

As described above, the recovery tank 205 is arranged so that the liquid level 205*a* is below the ejection orifice surface 201*a* of the liquid ejection head 201 in the gravitational direction. More specifically, the liquid level 205*a* in the recovery tank 205 is located below the ejection orifice surface 201*a* of the liquid ejection head 201 in the gravitational direction so that the pressure in the ejection orifices in the liquid ejection head 201 may be an appropriate negative pressure. With this, the liquid ejection head 201 according to this embodiment can keep a state in which liquid menisci are formed in the ejection orifices while the liquid is circulated along the circulating path described above, thereby being capable of normally ejecting the liquid.

Meanwhile, in the pressure chamber in the liquid ejection head 201, the liquid flows from the supply opening toward the recovery opening in the vicinity of the ejection orifice because the liquid is circulated. With this, an air bubble formed due to pressure fluctuations when the liquid is ejected can be discharged to the recovery opening without remaining in the vicinity of the ejection orifice, and further, thickening of the liquid in the ejection orifice can be suppressed.

As the liquid is consumed through ejection, the liquid in the supply tank 203 gradually reduces. In such a case, the supply tank 203 can be refilled with the liquid from the main tank 202. Specifically, when the liquid level sensor 204 detects that the liquid level 203*a* in the supply tank 203 is below a predetermined level, the control portion 220 can drive the refill pump 207 to refill the supply tank 203 with the liquid from the main tank 202 via the refill flow path 208. With this, the liquid level 203*a* in the supply tank 203 can be held at the predetermined level or higher.

(Pressurizing Recovery Operation)

In the pressurizing recovery operation, as illustrated in FIG. 7, the control portion 220 controls the supply switching valve 212 to connect the pressurized flow path 211 and the liquid supply flow path 215 to each other, and controls the circulation switching valve 213 to connect the circulation flow path 216 and the pressurized flow path 211 to each other. With this, the circulation flow path 216, the pressurized flow path 211, and the liquid supply flow path 215 function as a fourth flow path configured to connect the recovery tank 205 and the liquid ejection head 201 to each other. Therefore, in the pressurizing recovery operation, there is formed a circulating path including the recovery tank 205, the fourth flow path 216, 211, and 215, the liquid ejection head 201, and the second flow path 217, that is, a circulating path that does not include the supply tank 203.

In this state, the control portion 220 first drives the circulation pump 214 and performs forced circulation as indicated by the arrows in FIG. 7. Therefore, the circulation pump 214 functions as a pressure pump configured to pressurize the liquid in the recovery tank 205 and supply the liquid to the liquid ejection head 201 via the fourth flow path 216, 211, and 215. In this way, the pressurized liquid is supplied to the liquid ejection head 201, and as a result, an air bubble remaining in the flow paths and in the pressure chamber can be discharged to the recovery tank 205. At this time, in the recovery tank 205, an opening (outlet) of the liquid recovery flow path 217 is located above an opening (inlet) of the circulation flow path 216 in the gravitational direction to prevent an air bubble discharged from the liquid ejection head 201 from being recirculated via the circulation flow path 216. Further, according to this embodiment, the liquid is pressurized by the circulation pump (pressure pump) 214 without air therebetween, and thus efficient pressurization can be performed.

Incidentally, in the liquid ejection head 201 having the structure illustrated in FIG. 1, the recovery path has a large flow path resistance, and thus, in order to remove an air bubble remaining in the recovery path, the circulated liquid is required to have a large flow rate and a large pressure difference. However, when the ejection orifices are in an uncovered state, such a large flow rate and such a large pressure difference results in jetting of the liquid through the ejection orifices, which disables pressurizing recovery of the recovery path and wastes a large amount of the liquid.

Therefore, the control portion 220 then brings the cap 218 into abutment against the ejection orifice surface 201*a* of the liquid ejection head 201 and controls the cap sealing valve 219 to hermetically seal a space formed by the cap 218 and the ejection orifice surface 201*a*. With this, even when the liquid flows with a large pressure difference, the pressure in the cap 218 is balanced with the pressure in the pressure chambers in the liquid ejection head 201, and thus the liquid flows toward the recovery openings instead of being jetted through the ejection orifices. As a result, an air bubble remaining in the recovery path can be removed without fail, and the consumption of the liquid can be reduced.

Through both pressurization and supply of the liquid by the circulation pump (pressure pump) 214 and formation of the hermetically sealed space by the cap 218, a substantially similar effect of recovery can be obtained regardless of the order of performing the two operations. Therefore, the order may be opposite to that described above, i.e., the circulation pump 214 may pressurize and supply the liquid after the cap 218 forms the hermetically sealed space, or the two operations may be performed at the same time. When the liquid is pressurized and supplied first, not only the thickened liquid or air in the ejection orifices can be discharged but also additional air, which is forced into the ejection orifices when the hermetically sealed space is formed, can be prevented from mixing into the liquid. When the hermetically sealed space is formed first, the amount of the liquid wasted by being jetted through the ejection orifices can be further reduced.

After that, the control portion 220 drives the circulation pump (pressure pump) 214 for a predetermined time period to sufficiently remove an air bubble in the liquid supply flow path 215 and the liquid recovery flow path 217. Then, the control portion 220 opens the cap sealing valve 219 to unseal the space in the cap 218. This is for the purpose of, simultaneously with depressurization of the space in the cap 218, discharging an air bubble and the thickened liquid in the ejection orifices in the liquid ejection head 201 through the ejection orifices.

Then, the control portion 220 stops the circulation pump 214, depressurizes the liquid in the liquid supply flow path 215 and the liquid ejection head 201, and moves the cap 218 away from the ejection orifice surface 201*a* of the liquid ejection head 201. Then, the control portion 220 moves a wiping member (not shown) to a position opposed to the ejection orifice surface 201*a* and causes the wiping member to wipe and remove the liquid remaining on the ejection orifice surface 201*a*. After that, the control portion 220 controls the supply switching valve 212 to connect the supply connection flow path 209 and the liquid supply flow path 215 to each other, thereby resuming the circulation of the liquid due to the pressure head difference described above. Then, the control portion 220 controls the circulation switching valve 213 to connect the circulation flow path 216 and the return flow path 210 to each other. Finally, the control portion 220 resumes control of driving of the circulation pump 214 using the liquid level sensor 206 of the recovery tank 205 and control of driving of the refill pump 207 using the liquid level sensor 204 of the supply tank 203, to thereby resume the circulation of the liquid when the liquid is ejected illustrated in FIG. 6.

According to this embodiment, through such pressurizing recovery operation, an air bubble in the flow path that cannot be removed through circulation of the liquid when the liquid is ejected as described above can be discharged. Further, the liquid pressurized by the circulation pump (pressure pump) 214 is supplied to the liquid ejection head 201 only via the fourth flow path (the circulation flow path 216, the pressurized flow path 211, and the liquid supply flow path 215) without passing through a tank containing air or the like. Therefore, return to atmospheric pressure after the pressurizing recovery operation can be made promptly, and as a result, unnecessary consumption of the liquid can be reduced. Further, formation of the hermetically sealed space by the cap 218 between the cap 218 and the ejection orifice surface 201*a* of the liquid ejection head 201 can suppress jetting of the liquid through the ejection orifices to reduce the consumption of the liquid.

In the illustrated embodiment, the cap 218 is configured to form the hermetically sealed space in a state of being away from the ejection orifices, but when a member that does not damage the ejection orifice surface 201*a* is used, the cap 218 may include a member that is brought into close contact with the ejection orifices for hermetic sealing and a liquid sump.

(Power Off Operation)

In the power off operation, the control portion 220 controls the supply switching valve 212 to connect the pressurized flow path 211 and the liquid supply flow path 215 to each other, and controls the circulation switching valve 213 to connect the circulation flow path 216 and the return flow path 210 to each other. With this, a circulating path of the liquid is not formed as illustrated in FIG. 8, and thus the liquid no longer flows. As a result, such a state can be prevented from being established that the liquid is not present in the liquid ejection head 201. Further, on the recovery tank 205 side, the negative pressure is kept due to the pressure head difference with the ejection orifice surface 201*a* of the liquid ejection head 201, and thus the state in which appropriate menisci are formed in the ejection orifices can be kept.

Second Embodiment

Figure 9:
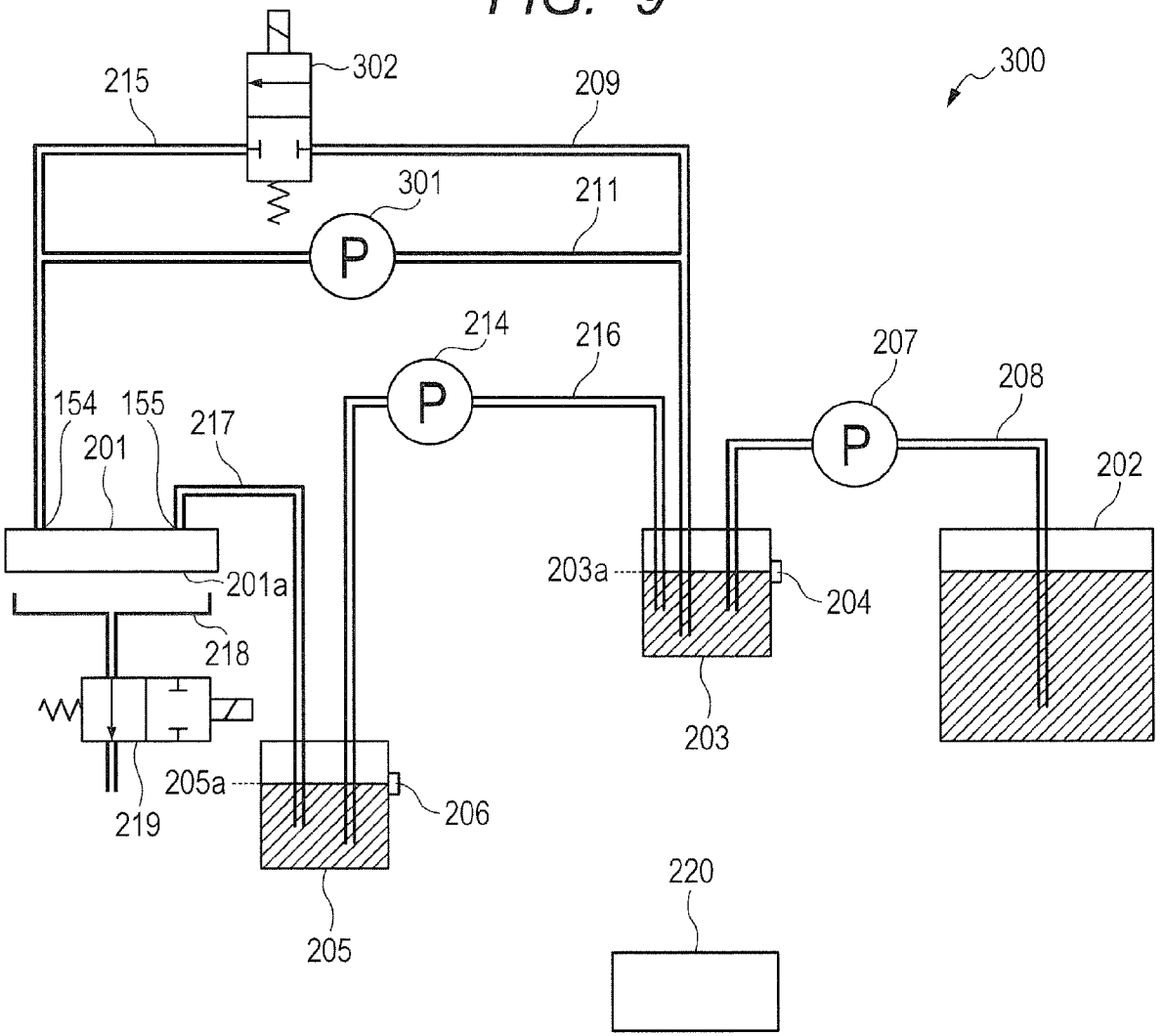
FIG. 9 is a schematic view for illustrating the flow path structure of a liquid ejection device according to a second embodiment of the present invention.

FIG. 9 is a schematic view for illustrating the flow path structure of a liquid ejection device according to a second embodiment of the present invention. This embodiment is different from the first embodiment in that a pressure pump 301 configured to pressurize and supply the liquid to the liquid ejection head 201 for the pressurizing recovery operation is arranged separately from the circulation pump 214. Specifically, in this embodiment, instead of the supply switching valve 212 according to the first embodiment, a liquid supply valve 302 configured to connect the supply connection flow path 209 and the liquid supply flow path 215 to each other is arranged. The pressurized flow path 211 is connected to the supply connection flow path 209 and the liquid supply flow path 215 so as to bypass the liquid supply valve 302, and the pressure pump 301 is arranged in the pressurized flow path 211. Therefore, according to this embodiment, the pressurized flow path 211 connects the supply tank 203 and the liquid ejection head 201 to each other, and functions as a fourth flow path configured to supply the liquid pressurized by the pressure pump 301 to the liquid ejection head 201. Further, the one end of the circulation flow path 216 is connected to the recovery tank 205, and the another end thereof is connected to the supply tank 203. Specifically, according to this embodiment, the circulation flow path 216 functions as a third flow path configured to connect the recovery tank 205 and the supply tank 203 to each other. Therefore, the circulation switching valve 213 and the return flow path 210 according to the first embodiment are not arranged.

In a liquid ejection device 300 according to this embodiment, in the liquid ejection operation, the control portion 220 opens the liquid supply valve 302 to connect the supply connection flow path 209 and the liquid supply flow path 215 to each other. In this way, the liquid is circulated due to a pressure head difference similarly to the first embodiment. Meanwhile, in the pressurizing recovery operation, the control portion 220 closes the liquid supply valve 302 to shut off the connection between the supply connection flow path 209 and the liquid supply flow path 215, and stops the supply of the liquid from the supply tank 203 to the liquid ejection head 201. Then, the control portion 220 drives the pressure pump 301 to pressurize the liquid in the supply tank 203 and supply the liquid to the liquid ejection head 201. In this manner, the pressurizing recovery operation similar to that of the first embodiment is performed.

With this structure, there can be performed high-flow control for supplying the pressurized liquid to the liquid ejection head 201 and low-flow control for adjusting the liquid level in the recovery tank 205 by separate pumps, which are performed by a single pump according to the first embodiment. Therefore, the respective types of flow control can be performed with ease. Further, in the pressurizing recovery operation, the liquid is conveyed from the recovery tank 205 to the supply tank 203, and thus liquid shortage in the supply tank 203 and a liquid overflow from the recovery tank 205 can be suppressed to enable the pressurizing recovery operation for a long time.

Instead of connecting a downstream side of the pressurized flow path 211 to the liquid supply flow path 215, two supply ports may be formed in the liquid ejection head 201, and one of the supply ports may be connected to the liquid supply flow path 215 and another of the supply ports may be connected to the pressurized flow path 211. Further, an upstream side of the pressurized flow path 211 may be directly connected to the supply tank 203.

Third Embodiment

Figure 10:
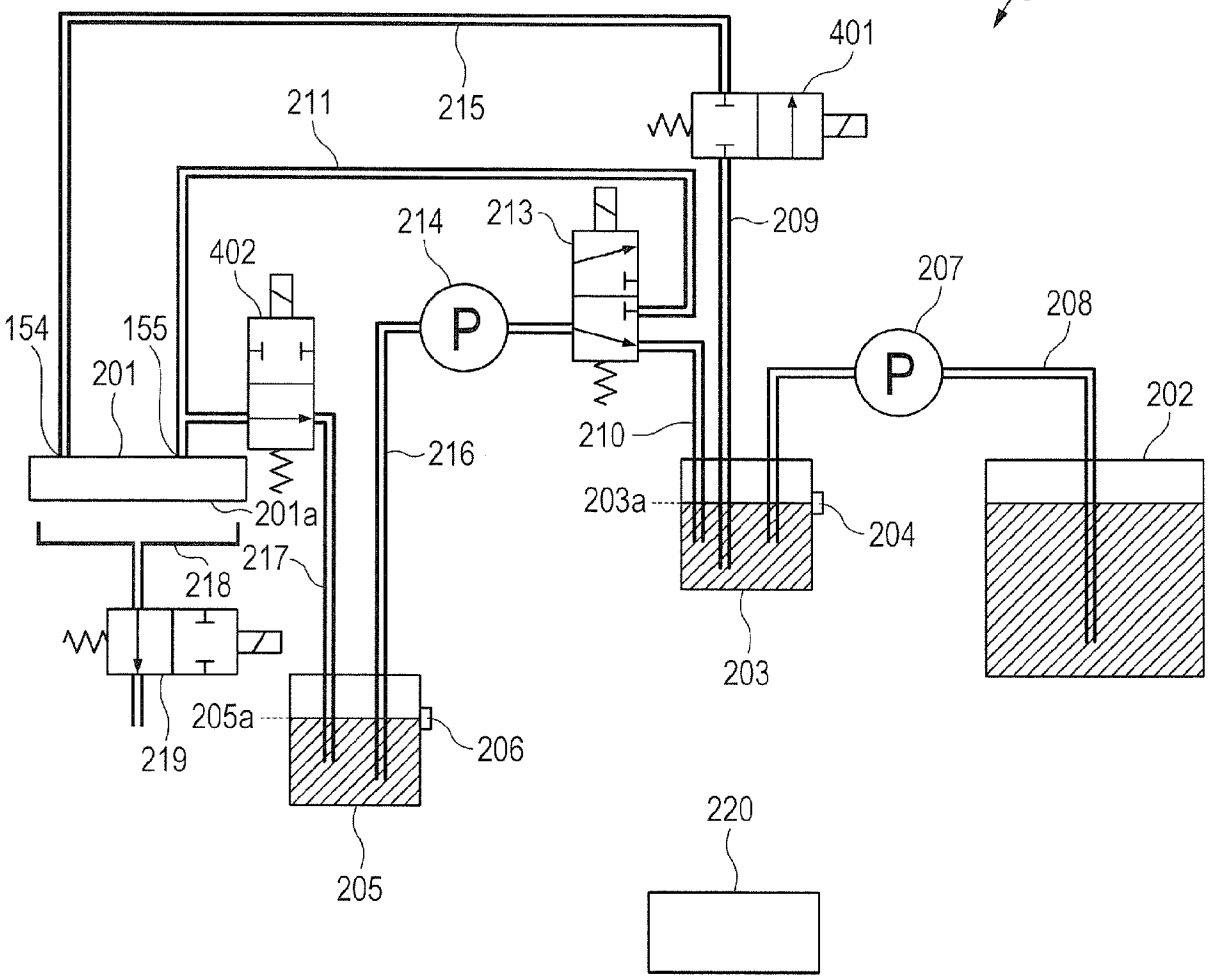
FIG. 10 is a schematic view for illustrating the flow path structure of a liquid ejection device according to a third embodiment of the present invention.

FIG. 10 is a schematic view for illustrating the flow path structure of a liquid ejection device according to a third embodiment of the present invention.

The pressurizing recovery operation for the liquid ejection head 201 is expected to have an equivalent effect regardless of whether the operation is conducted from the supply-side flow path or the operation is conducted from the recovery-side flow path. Accordingly, this embodiment is different from the first embodiment in that, in the pressurizing recovery operation, the pressurized liquid is supplied to the liquid ejection head 201 from the recovery-side flow path. Specifically, instead of the supply switching valve 212 according to the first embodiment, a liquid supply valve 401 configured to connect the supply connection flow path 209 and the liquid supply flow path 215 is arranged, and the pressurized flow path 211 is directly connected to the recovery port in the liquid ejection head 201. Along with this, according to this embodiment, the liquid recovery flow path 217 is connected to the pressurized flow path 211 via a liquid recovery valve 402.

In a liquid ejection device 400 according to this embodiment, in the liquid ejection operation, the control portion 220 opens the liquid supply valve 401 to connect the supply connection flow path 209 and the liquid supply flow path 215 to each other. Then, the control portion 220 opens the liquid recovery valve 402 to connect the recovery port in the liquid ejection head 201 and the liquid recovery flow path 217 to each other, and controls the circulation switching valve 213 to connect the circulation flow path 216 and the return flow path 210 to each other. In this way, the liquid is circulated due to a pressure head difference similarly to the first embodiment. Meanwhile, in the pressurizing recovery operation, the control portion 220 closes the liquid recovery valve 402 to shut off the connection between the recovery port in the liquid ejection head 201 and the liquid recovery flow path 217, and controls the circulation switching valve 213 to connect the circulation flow path 216 and the pressurized flow path 211 to each other. Therefore, in this case, the circulation flow path 216 and the pressurized flow path 211 function as a fourth flow path configured to connect the recovery tank 205 and the liquid ejection head 201 to each other. Through driving of the circulation pump 214, forced circulation in a direction opposite to that according to the first embodiment, that is, from the recovery-side flow path to the supply-side flow path in the liquid ejection head 201, is performed.

Incidentally, in the liquid ejection head 201 having the structure illustrated in FIG. 1, when the liquid is circulated through the pressure chamber, it is desired that the supply path and the recovery path have a flow path resistance larger than that of the ejection orifices. Further, for the purpose of supplying the liquid sufficiently, it is desired that the recovery path have a flow path resistance larger than that of the supply path. In such a liquid ejection head 201, it is more difficult to remove an air bubble in the recovery path than in the supply path. According to the structure of this embodiment, the pressurizing recovery operation can be performed from the recovery-side flow path, and as a result, the recovery path can be recovered without fail.

Instead of connecting an upstream side of the liquid recovery flow path 217 to the pressurized flow path 211, two recovery ports may be formed in the liquid ejection head 201, and one of the recovery ports may be connected to the pressurized flow path 211 and another of the recovery ports may be connected to the liquid recovery flow path 217.

As described above, according to the present invention, droplet ejection performance can be satisfactorily maintained while unnecessary liquid consumption is reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-208144, filed Oct. 22, 2015, which is hereby incorporated by reference herein in its entirety.

What is claimed is:

1. A liquid ejection device, comprising:

a liquid ejection head comprising:

a supply port configured to supply liquid to a pressure chamber, the pressure chamber communicating with an ejection orifice for ejecting the liquid; and a recovery port configured to recover the liquid supplied to the pressure chamber;

a first flow path connected to the supply port of the liquid ejection head;

a supply tank configured to store the liquid supplied to the liquid ejection head, the supply tank being connected to the supply port of the liquid ejection head via the first flow path;

a second flow path connected to the recovery port of the liquid ejection head;

a recovery tank configured to store the liquid recovered from the liquid ejection head, the recovery tank being connected to the recovery port of the liquid ejection head via the second flow path, and a liquid level of the recovery tank being below an ejection orifice surface in which the ejection orifice of the liquid ejection head opens in a gravitational direction and being below a liquid level of the supply tank in the gravitational direction;

a third flow path configured to connect the supply tank and the recovery tank to each other;

a circulation pump configured to return the liquid in the recovery tank to the supply tank, the circulation pump being arranged in the third flow path;

a fourth flow path configured to connect one of the supply tank and the recovery tank to the liquid ejection head;

a pressure pump configured to pressurize the liquid in the one of the supply tank and the recovery tank and supply the liquid to the liquid ejection head, the pressure pump being arranged in the fourth flow path; and a control portion configured to switch between liquid ejection operation in which the liquid is ejected from the liquid ejection head while the liquid is circulated along the first flow path to the third flow path and pressurizing recovery operation in which the liquid pressurized by the pressure pump is supplied to the liquid ejection head via the fourth flow path, wherein the first flow path comprises:

a liquid supply flow path having one end connected to the supply port of the liquid ejection head and another end connected to a supply switching valve; and a supply connection flow path having one end connected to the supply switching valve and another end connected to the supply tank, wherein the second flow path comprises a liquid recovery flow path configured to connect the recovery port of the liquid ejection head and the recovery tank to each other, wherein the third flow path comprises:

a circulation flow path having one end connected to the recovery tank and another end connected to a circulation switching valve, and comprising the circulation pump; and a return flow path having one end connected to the circulation switching valve and another end connected to the supply tank, wherein the fourth flow path comprises:

the circulation flow path;

the liquid supply flow path; and a pressurized flow path having one end connected to the circulation switching valve and another end connected to the supply switching valve, wherein the circulation pump also serves as the pressure pump, and wherein the control portion is configured to control the supply switching valve and the circulation switching valve to switch between the liquid ejection operation and the pressurizing recovery operation.

2. A liquid ejection device according to claim 1, wherein the control portion is configured to, in the liquid ejection operation:

control the supply switching valve to connect the liquid supply flow path and the supply connection flow path to each other; and control the circulation switching valve to connect the circulation flow path and the return flow path to each other, and wherein the control portion is configured to, in the pressurizing recovery operation:

control the supply switching valve to connect the liquid supply flow path and the pressurized flow path to each other; and control the circulation switching valve to connect the circulation flow path and the pressurized flow path to each other.

3. A liquid ejection device according to claim 1, wherein the control portion is configured to, in power off operation:

control the supply switching valve to connect the liquid supply flow path and the pressurized flow path to each other; and control the circulation switching valve to connect the circulation flow path and the return flow path to each other.

4. A liquid ejection device according to claim 1, wherein the first flow path comprises:

a liquid supply flow path having one end connected to the supply port of the liquid ejection head and another end connected to a liquid supply valve; and a supply connection flow path having one end connected to the liquid supply valve and another end connected to the supply tank, wherein the second flow path comprises a liquid recovery flow path configured to connect the recovery port of the liquid ejection head and the recovery tank to each other, wherein the third flow path comprises a circulation flow path having one end connected to the recovery tank and another end connected to the supply tank, and comprising the circulation pump, wherein the fourth flow path comprises a pressurized flow path having one end connected to the supply port of the liquid ejection head and another end connected to the supply tank, and comprising the pressure pump, and wherein the control portion is configured to control the liquid supply valve and the pressure pump to switch between the liquid ejection operation and the pressurizing recovery operation.

5. A liquid ejection device according to claim 4, wherein the control portion is configured to, in the liquid ejection operation:

open the liquid supply valve to connect the liquid supply flow path and the supply connection flow path to each other; and stop the pressure pump, and wherein the control portion is configured to, in the pressurizing recovery operation:

close the liquid supply valve to shut off the connection between the liquid supply flow path and the supply connection flow path; and drive the pressure pump.

6. A liquid ejection device, comprising:

a liquid ejection head comprising:

a supply port configured to supply liquid to a pressure chamber, the pressure chamber communicating with an ejection orifice for ejecting the liquid; and a recovery port configured to recover the liquid supplied to the pressure chamber;

a first flow path connected to the supply port of the liquid ejection head;

a supply tank configured to store the liquid supplied to the liquid ejection head, the supply tank being connected to the supply port of the liquid ejection head via the first flow path;

a second flow path connected to the recovery port of the liquid ejection head;

a recovery tank configured to store the liquid recovered from the liquid ejection head, the recovery tank being connected to the recovery port of the liquid ejection head via the second flow path, and a liquid level of the recovery tank being below an ejection orifice surface in which the ejection orifice of the liquid ejection head opens in a gravitational direction and being below a liquid level of the supply tank in the gravitational direction;

a third flow path configured to connect the supply tank and the recovery tank to each other;

a circulation pump configured to return the liquid in the recovery tank to the supply tank, the circulation pump being arranged in the third flow path;

a fourth flow path configured to connect one of the supply tank and the recovery tank to the liquid ejection head;

a pressure pump configured to pressurize the liquid in the one of the supply tank and the recovery tank and supply the liquid to the liquid ejection head, the pressure pump being arranged in the fourth flow path; and a control portion configured to switch between liquid ejection operation in which the liquid is ejected from the liquid ejection head while the liquid is circulated along the first flow path to the third flow path and pressurizing recovery operation in which the liquid pressurized by the pressure pump is supplied to the liquid ejection head via the fourth flow path, wherein the first flow path comprises:

a liquid supply flow path having one end connected to the supply port of the liquid ejection head and another end connected to a liquid supply valve; and a supply connection flow path having one end connected to the liquid supply flow path via the liquid supply valve and another end connected to the supply tank, wherein the second flow path comprises a liquid recovery flow path having one end connected to the recovery port of the liquid ejection head via a liquid recovery valve and another end connected to the recovery tank, wherein the third flow path comprises:

a circulation flow path having one end connected to the recovery tank and another end connected to a circulation switching valve, and comprising the circulation pump; and a return flow path having one end connected to the circulation switching valve and another end connected to the supply tank, wherein the fourth flow path comprises:

the circulation flow path; and a pressurized flow path having one end connected to the circulation switching valve and another end connected to the recovery port of the liquid ejection head, wherein the circulation pump also serves as the pressure pump, and wherein the control portion is configured to control the liquid supply valve, the circulation switching valve, and the liquid recovery valve to switch between the liquid ejection operation and the pressurizing recovery operation.

7. A liquid ejection device according to claim 6, wherein the control portion is configured to, in the liquid ejection operation:

open the liquid supply valve to connect the liquid supply flow path and the supply connection flow path to each other;

control the circulation switching valve to connect the circulation flow path and the return flow path to each other; and open the liquid recovery valve to connect the recovery port of the liquid ejection head and the liquid recovery flow path to each other, and wherein the control portion is configured to, in the pressurizing recovery operation:

close the liquid supply valve to shut off the connection between the liquid supply flow path and the supply connection flow path;

control the circulation switching valve to connect the circulation flow path and the pressurized flow path to each other; and close the liquid recovery valve to shut off the connection between the recovery port of the liquid ejection head and the liquid recovery flow path.

8. A liquid ejection device according to claim 1, further comprising:

a cap that is formed so as to be movable between a position at which the cap abuts against the ejection orifice surface of the liquid ejection head and a position at which the cap is apart from the ejection orifice surface; and a cap sealing valve mounted to the cap, and configured to open/close a space formed between the cap and the ejection orifice surface of the liquid ejection head, wherein, the control portion is configured to, in the pressurizing recovery operation, control the cap and the cap sealing valve to hermetically seal the space between the ejection orifice surface of the liquid ejection head and the cap.

9. A liquid ejection device according to claim 1, wherein the control portion is configured to drive the circulation pump so that a liquid level in the recovery tank is a predetermined level or lower based on an output signal of a liquid level sensor configured to detect the liquid level in the recovery tank.

10. A liquid ejection device according to claim 1, further comprising:

a main tank connected to the supply tank via a refill flow path; and a refill pump arranged in the refill flow path, and configured to refill the supply tank with the liquid in the main tank, wherein the control portion is configured to drive the refill pump so that a liquid level in the supply tank is a predetermined level or higher based on an output signal of a liquid level sensor configured to detect the liquid level in the supply tank.

* * * * *